US009222280B2

(12) United States Patent
Mackle

(10) Patent No.: US 9,222,280 B2
(45) Date of Patent: Dec. 29, 2015

(54) LOCKING MECHANISM

(75) Inventor: Trevor Mackle, Hornsby (AU)

(73) Assignee: FIRE & SECURITY HARDWARE PTY LTD, New South Wales (AU)

( * ) Notice: Subject to any disclaimer, the term of this patent is extended or adjusted under 35 U.S.C. 154(b) by 346 days.

(21) Appl. No.: 13/805,968

(22) PCT Filed: May 31, 2011

(86) PCT No.: PCT/AU2011/000652

§ 371 (c)(1),
(2), (4) Date: Dec. 20, 2012

(87) PCT Pub. No.: WO2011/160161

PCT Pub. Date: Dec. 29, 2011

(65) Prior Publication Data

US 2013/0088024 A1 Apr. 11, 2013

(30) Foreign Application Priority Data

Jun. 23, 2010 (AU) ..... 2010902758
Aug. 30, 2010 (AU) ..... 2010903863

(51) Int. Cl.

| | |
|---|---|
| ***E05C 19/00*** | (2006.01) |
| ***E05B 15/02*** | (2006.01) |
| ***E05B 47/06*** | (2006.01) |
| ***E05B 47/00*** | (2006.01) |

(52) U.S. Cl.

CPC ..... *E05B 15/0205* (2013.01); *E05B 47/0047* (2013.01); *E05B 47/0607* (2013.01); *E05C 19/009* (2013.01); *Y10T 292/696* (2015.04); *Y10T 292/699* (2015.04)

(58) Field of Classification Search

CPC ..... E05C 19/009; E05B 47/0046; E05B 47/0047; E05B 47/0067; E05B 47/0069; E05B 15/02; E05B 15/0205; E05B 15/0093; E05B 47/0607; E05B 63/121

USPC ..... 292/252, 137, 163, 164, 168, 170, 138, 292/140, 144, 340, 341.15, 341.16, 341.17, 292/DIG. 25; 74/527, 528, 529; 403/DIG. 6; 411/21, 348, 549; 70/34, 386, 276

See application file for complete search history.

(56) References Cited

U.S. PATENT DOCUMENTS 3,405,569 A * 10/1968 Wroble ..... 74/527
3,525,242 A * 8/1970 Young ..... 70/231

(Continued)

FOREIGN PATENT DOCUMENTS

BR PI8804349 A 4/1990
WO 83/00523 A1 2/1983

OTHER PUBLICATIONS

International Search Report (Date of Mailing Jul. 15, 2011).

*Primary Examiner* — Alyson M Merlino
(74) *Attorney, Agent, or Firm* — Howard & Howard Attorneys PLLC

(57) ABSTRACT

A locking mechanism is disclosed including: a plunger; a plurality of locking elements; a cage including apertures in which the locking elements are housed; and a sleeve; the sleeve is moveable with respect to the cage between an unlocked position and a locked position; in the locked position, the sleeve maintains the locking elements in engagement with a recess on the plunger to restrict the movement of the plunger.

5 Claims, 13 Drawing Sheets

(56) References Cited

U.S. PATENT DOCUMENTS 4,901,544 A * 2/1990 Jang ..... 70/218
5,141,355 A * 8/1992 Stillwagon ..... 403/325
5,186,516 A * 2/1993 Alexander et al. ..... 296/121
8,720,874 B2 * 5/2014 Tschida et al. ..... 269/48.1
2007/0145821 A1 6/2007 Mekky et al.
2009/0235767 A1 * 9/2009 Garneau et al. ..... 74/56

* cited by examiner

LOCKING MECHANISM

CROSS REFERENCE TO RELATED APPLICATION

This application is a national stage application of PCT/AU2011/000652, filed May 31, 2011, which claims priority to Australian Patent Application No. 2010-902758, filed Jun. 23, 2010 and Australian Patent Application No. 2010-903863, filed Aug. 30, 2010, the disclosures of which are hereby incorporated by reference in their entirety.

TECHNICAL FIELD

The present invention relates to locking mechanisms for use in electric locking devices. The invention particularly relates to a locking mechanism with improved pre-load function.

BACKGROUND TO THE INVENTION

Electric locking devices such as electric strikes, for example, are typically used as components in electronic locking systems to provide security access control in buildings or the like. They are fitted to a door jamb, usually in association with a mechanical lock. The strike includes a pivotally moveable keeper which retains the door latch of the mechanical lock. When the strike is in an unlocked condition, the keeper is free to rotate and release the door latch of the mechanical lock so the door may be pushed open. When the strike is in a locked condition, the keeper is not free to rotate and the door can only be opened by withdrawing the door latch manually.

The strike can be controlled by way of a card reader, or other access control system, located on the outside of the door. Typically, no handle is provided on the outside of the door, and a rotatable handle is provided on the inside. Therefore, from the inside, persons may operate the handle to leave the building, or area. From the outside, persons may only enter if they activate the access control system to release the electric strike from its locked condition.

Electric locking devices such as electric strikes are often subjected to a condition known as "pre-load". Pre-load is the name given to lateral forces applied to the keeper. These lateral forces may be caused, for example by warpage of a door or door frame, a person pushing on the door, or differences in air pressure on either side of the door such as might be caused by air conditioning or building ventilation systems.

If an electric strike is subjected to pre-load then this can affect correct operation of the strike. For instance, when under pre-load, the mechanism of the strike may become jammed and be unable to go from a locked condition to an unlocked condition. As well as being unsatisfactory and inconvenient, this situation also raises serious safety concerns. In the event of an emergency or the like, a central control system may send a signal to the strike to adopt the unlocked condition. If the lock becomes jammed due to pre-load then there is a risk that persons may be trapped behind doors, or that emergency workers cannot gain access through doors from the outside.

There remains a need to provide for electric locking devices with improved pre-load capabilities.

SUMMARY OF THE INVENTION

In a first aspect the present invention provides a locking mechanism including: a plunger; a plurality of locking elements; a cage including apertures in which the locking elements are housed; and a sleeve; the sleeve is moveable with respect to the cage between an unlocked position and a locked position; in the locked position, the sleeve maintains the locking elements in engagement with a recess on the plunger to restrict the movement of the plunger.

The locking elements may be generally spherical.

The sleeve may be moved between its unlocked and locked positions by rotating the sleeve.

The sleeve may include a threaded portion and whereby rotation of the sleeve causes it to move along its thread.

The plunger may be biased towards an extended position by way of a spring.

In a second aspect the present invention provides an electric locking device including a locking mechanism according to any preceding claim.

The sleeve may be driven by a motor and gearbox.

The electric locking device may further include an onboard power source which is arranged to provide power to move the sleeve to its unlocked position in the event or power being cut to the electric strike.

The locking device may be an electric strike and further includes: a keeper; a housing; the keeper is pivotally mounted in the housing and is moveable between a closed position an open position; the plunger cooperates with a formation on the keeper which is arranged to move the plunger when the keeper moves from the closed to the open positions.

In a third aspect the present invention provides a locking device which is arranged to be powered by an external power supply and including: an electric power storage means; and wherein the power storage means is arranged to operate the lock in the event of disconnection or failure of the external power supply to move the lock from a locked to an unlocked condition.

BRIEF DESCRIPTION OF THE DRAWINGS

An embodiment of the present invention will now be described, by way of example only, with reference to the accompanying drawings, in which.

DETAILED DESCRIPTION OF THE PREFERRED EMBODIMENT

Figure 1:
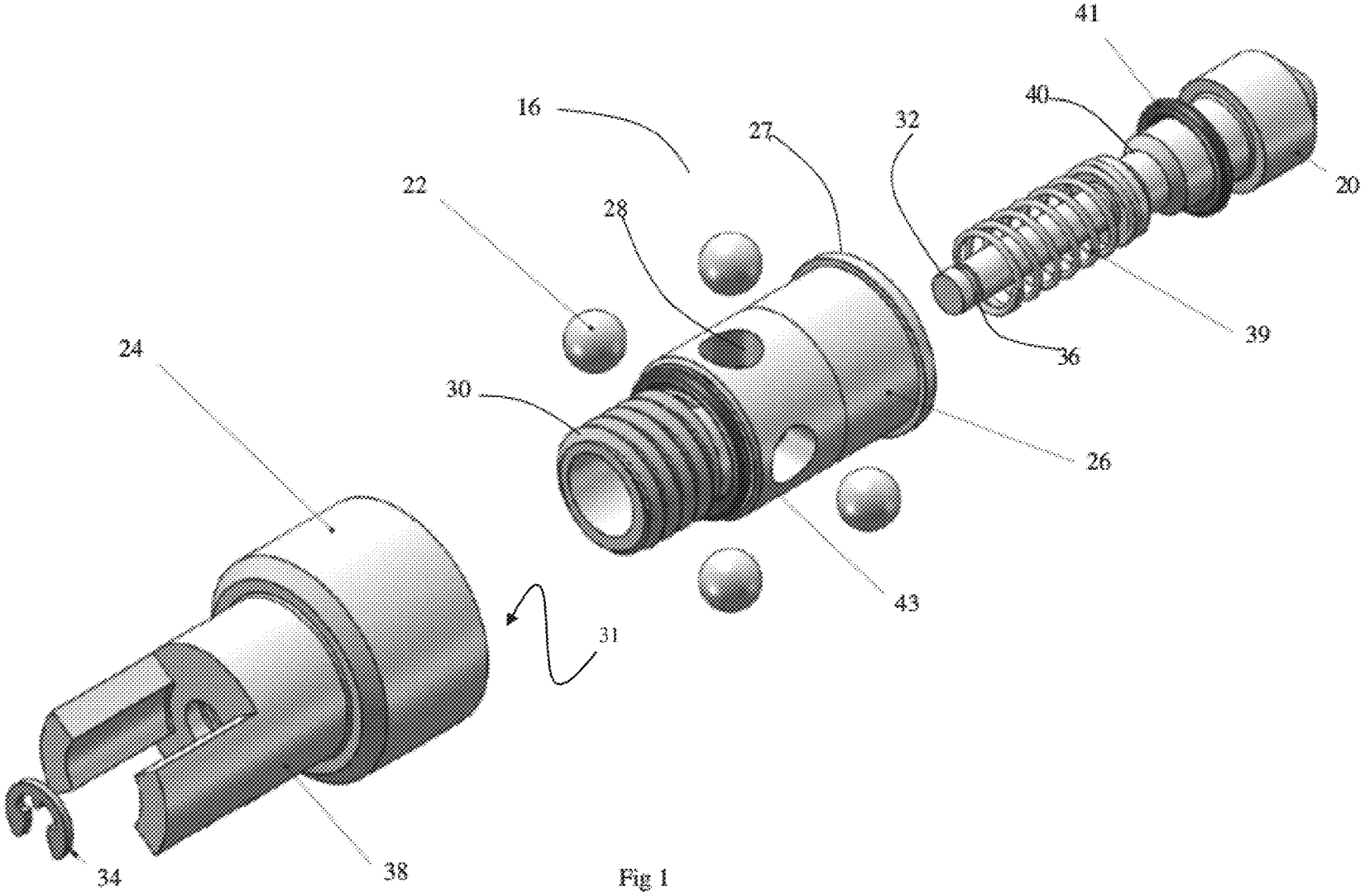
FIG. 1 is an exploded view of a locking mechanism according to an embodiment of the invention

Referring to FIG. 1, a locking mechanism 16 is shown in exploded detail and includes a plunger 20, four locking elements in the form of spherical balls 22, a sleeve 24, and a cage 26 which retains balls 22 in apertures 28. Cage 26 includes a mounting flange 27 and bears an external screw thread 30 which engages with an internal screw thread 31 provided inside sleeve 24. Sleeve 24 includes a dog 38 which is used to rotate the sleeve as will be later described. Plunger 20 includes a tail which is inserted through both of cage 30 and sleeve 24 and is secured by way of circlip 34 which engages with groove 36 on tail 32. Plunger 20 can move against the biasing force of compression spring 39 if the sleeve is in a position wherein balls 22 are free to move out of engagement of recess 40 of plunger as will be later described. Rubber "O" rings 41, 43 keep dust or other debris from entering the mechanism.

Figure 2:
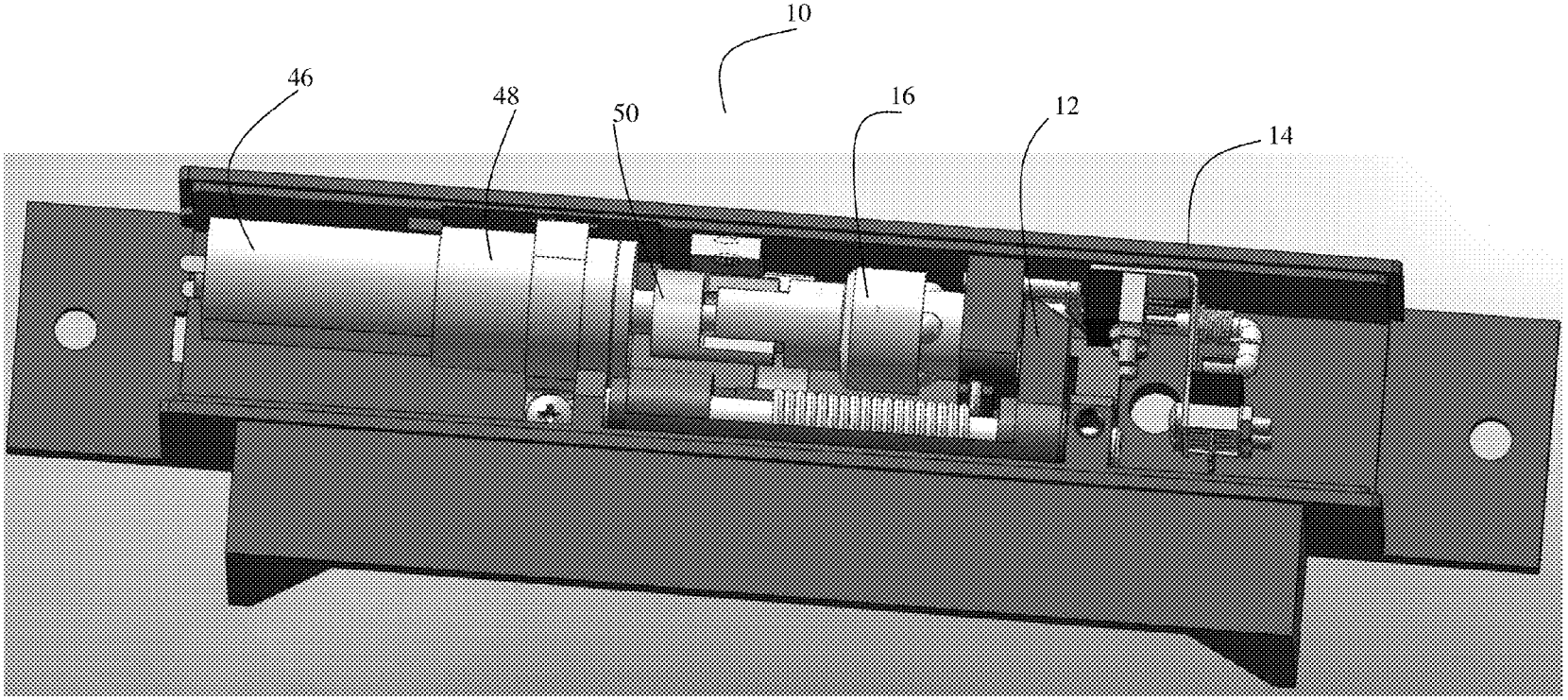
FIG. 2 is a rear perspective view of an electric strike incorporating the locking mechanism of FIG. 1.

Referring to FIG. 2, an electric strike 10 is shown including the locking mechanism 16 of FIG. 1. Strike 10 includes a keeper 12 and a housing 14. Keeper 12 is pivotally mounted to housing and is moveable between a closed position as seen in FIG. 1 to an open position as is well known in the art. In the closed position the keeper retains a latch of a mechanical door lock (not shown). Locking mechanism 16 controls whether the strike is in a locked or unlocked condition depending upon whether plunger 20 is free to move inwardly of cage 26 as will now be described.

Figure 3:
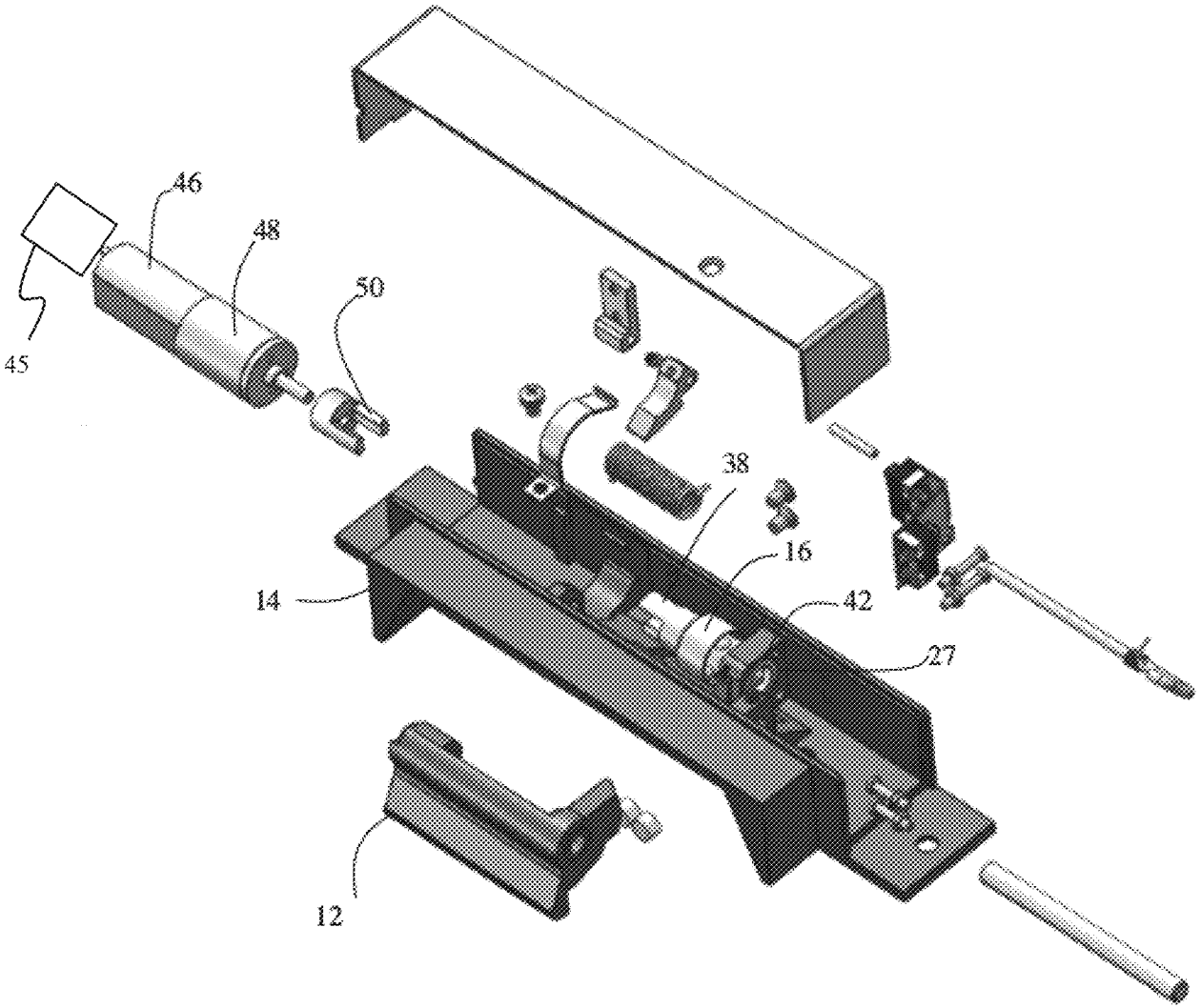
FIG. 3 is an exploded view of the electric strike of FIG. 2.

Referring to FIG. 3, locking mechanism 16 is mounted in housing 14 by way of inserting cage 26 into aperture 42 from the right hand side as shown in the figure. Mounting flange 27 limits the depth of insertion of cage 26 and prevents movement of cage 26 to the left as seen in the drawings.

A motor 46 and gearbox 48 arrangement is used to rotate sleeve 24. The output shaft of gearbox 48 carries a second dog 50 which engages with dog 38 of sleeve 24. The dogs 50, 38 are a sliding fit with one another. As will be seen, dog 50 remains in a laterally fixed position within the housing 14 on the end of the output shaft of gearbox 48, whereas sleeve 24 moves linearly to the left and to the right as sleeve rotates by interaction of screw threads 30 and 31. The dogs 50, 38 accommodate the linear movement of the sleeve to maintain rotational control of sleeve 24 by the motor 46 and gearbox 48 combination.

Figure 4:
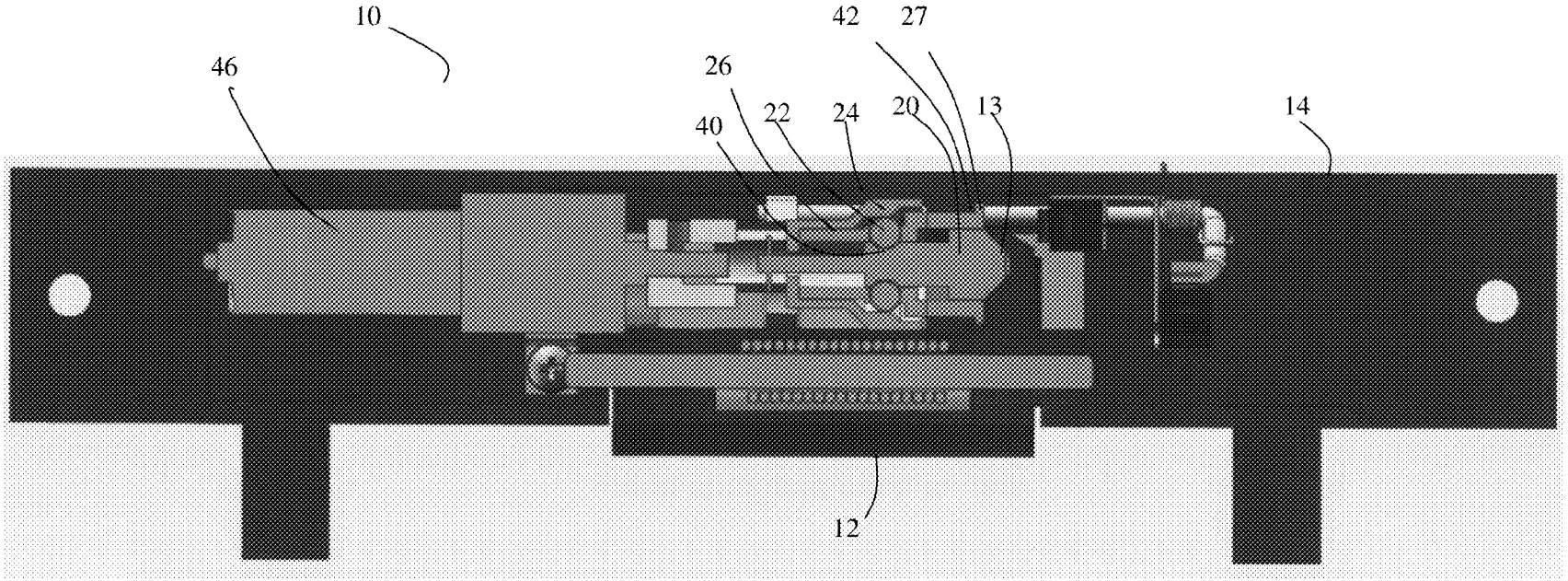
FIGS. 4 to 6 are cross sectional view of the strike of FIG. 2 illustrating switching from the locked to the unlocked condition whilst under pre-load.

Referring to FIG. 4, the strike is shown in cross sectional view in the locked and closed position. It can be seen that plunger 20 includes a tapered end, which is lying in a correspondingly tapered recess 13 in keeper 12. If a force is applied to keeper 12 to move the keeper to the open position, then this force is translated to urge the plunger to move linearly to the left in the drawings by interaction of the tapered plunger 20 and tapered recess 13.

As can be seen from FIG. 4, the balls 22 are engaged with recess 40 of plunger 20 and so prevent movement of plunger 20. The balls are retained in engagement with recess 40 by being surrounded by sleeve 24. The engagement of the balls 22 with recess 40 prevents movement of plunger 20 and therefore the strike is in a locked condition. Load applied to the keeper is transmitted to the plunger and is resisted by the balls 22 being restrained from moving outwardly by sleeve 24 and being restrained from moving to the left by apertures 28 of cage 26. It is to be noted that cage 26 cannot move to the left as seen in the drawings by way of engagement of flange 27 with aperture 42. Therefore, load applied to the keeper when in a locked state is borne by cage 26 in a lateral direction and radially by sleeve 24.

Figure 5:
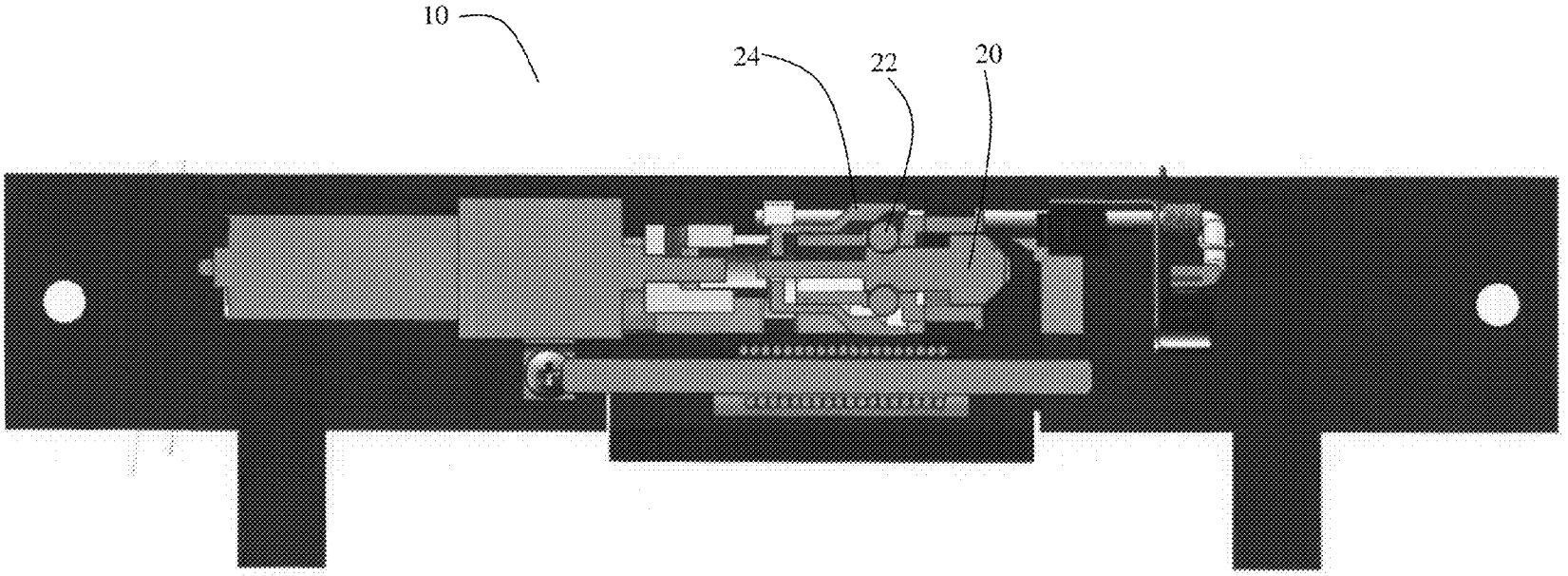
Figure 6:
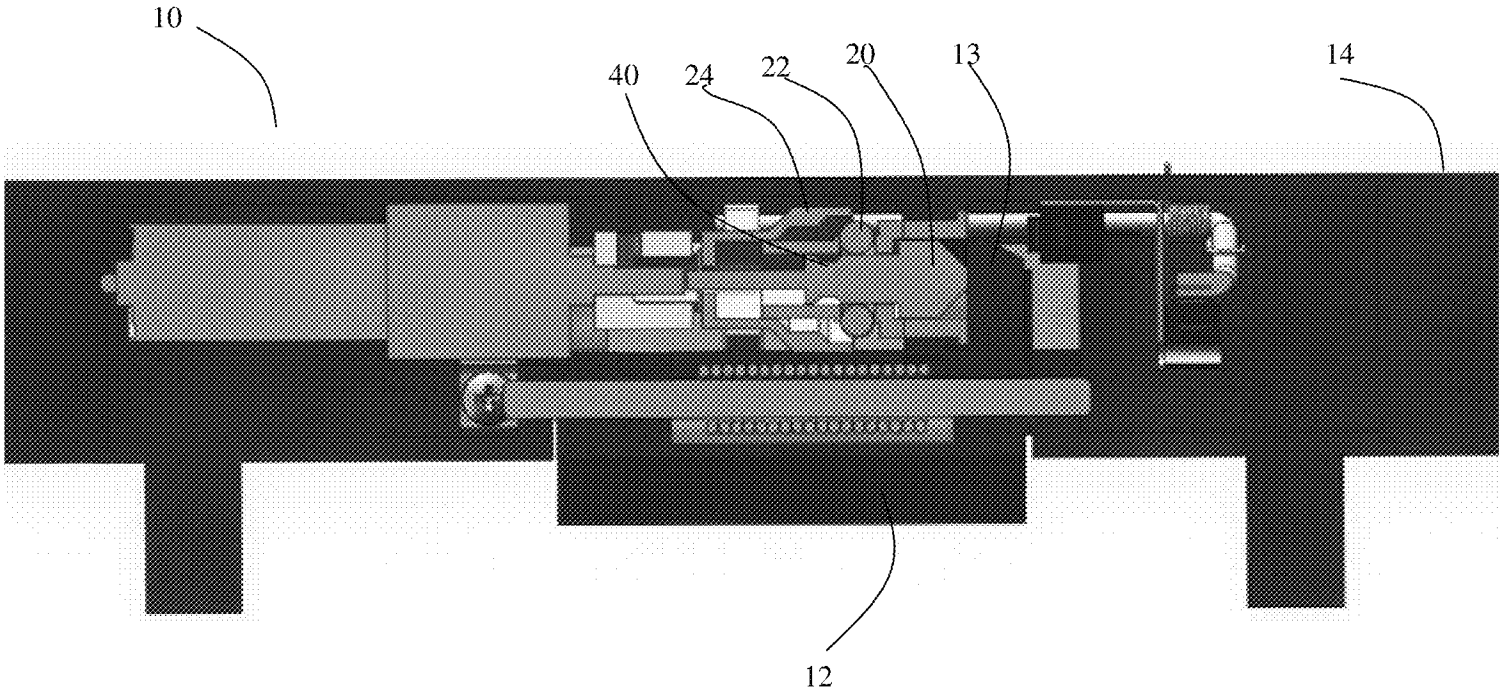

Operation of the strike to move from the locked condition to the unlocked condition is illustrated by the sequence of FIGS. 4 to 6. Referring to FIG. 5, with load applied to the keeper 12, lock has received a signal to move to the unlocked condition. Motor 46 has been activated to rotate sleeve 24 to cause it to move to the left in the drawings by way of rotating on screw thread 30. There is a frictional force between balls 22 and the inside surface of sleeve 24 due to the plunger 20 urging the balls 22 radially outwardly. However, motor 46 and gearbox combination 46, 48 provides sufficient rotational force to overcome this. Furthermore, the sleeve 24 and balls 22 are formed from stainless steel with a smooth surface finish to minimise these frictional forces. In FIG. 5, the balls 22 are almost at the point where they are free to move radially outwardly and out of engagement with recess 40.

Referring to FIG. 6, the sleeve 24 has continued to rotate and has moved further to the left and the strike is now in the unlocked condition. Balls 22 are no longer retained by sleeve 24. The balls 22 have moved outwardly to come out of engagement with recess 40 and plunger 20 has moved to the left, coming out of engagement with recess 13 as keeper 12 has rotated to the open position, thereby releasing a door latch.

Strike includes an on-board controller board or onboard power source 45 which provides power to the motor 46 to control the motor. The polarity of the power applied to the motor dictates whether the motor moves in a clockwise or anti-clockwise direction. The controller board senses when the sleeve is in the locked position by way of microswitch 13 which is actuated by the sleeve acting on pushrod 15. In other embodiments, the controller board may detect that the motor has reached the end of its stroke by the fact that, when unable to move further, the motor draws more current. This increase in current can be used to assume that the sleeve has reached a desired position. In other embodiments optical sensors or hall effect sensors are used to sense the position of the sleeve.

Lock 10 can operate in two modes, Fail Safe and Fail Secure. In the Fail Secure mode, in the event of a power cut to the lock, the lock remains in the locked position. In the Fail Safe mode, if power to the lock is cut, then the lock moves to the unlocked position (FIG. 6). The Fail Safe mode requires an on board power supply such as a battery, capacitor or super capacitor. In the event of a power cut, the on board power supply is used to power the motor. The lock is switched between modes by way of a jumper or dip-switch provided on the controller PCB of the electric strike (not shown). The changing of direction Fail Safe/Fail Secure can be made by either a manual function or electronically by means of reversing polarity on any form of electrical storage device, such as batteries or super capacitors An alternative embodiment of a locking mechanism 116 and electric strike 110 will be described with reference to FIGS. 7 to 13. Parts corresponding to those seen in locking mechanism 16 will be indicated by like reference numerals prefixed by the number "1". Identical parts to those used in locking device 16 will be indicated by the same reference numerals. The major difference in locking device 116 is that the sleeve rotates through only 45 degrees to move between the locked and unlocked conditions.

Figure 7:
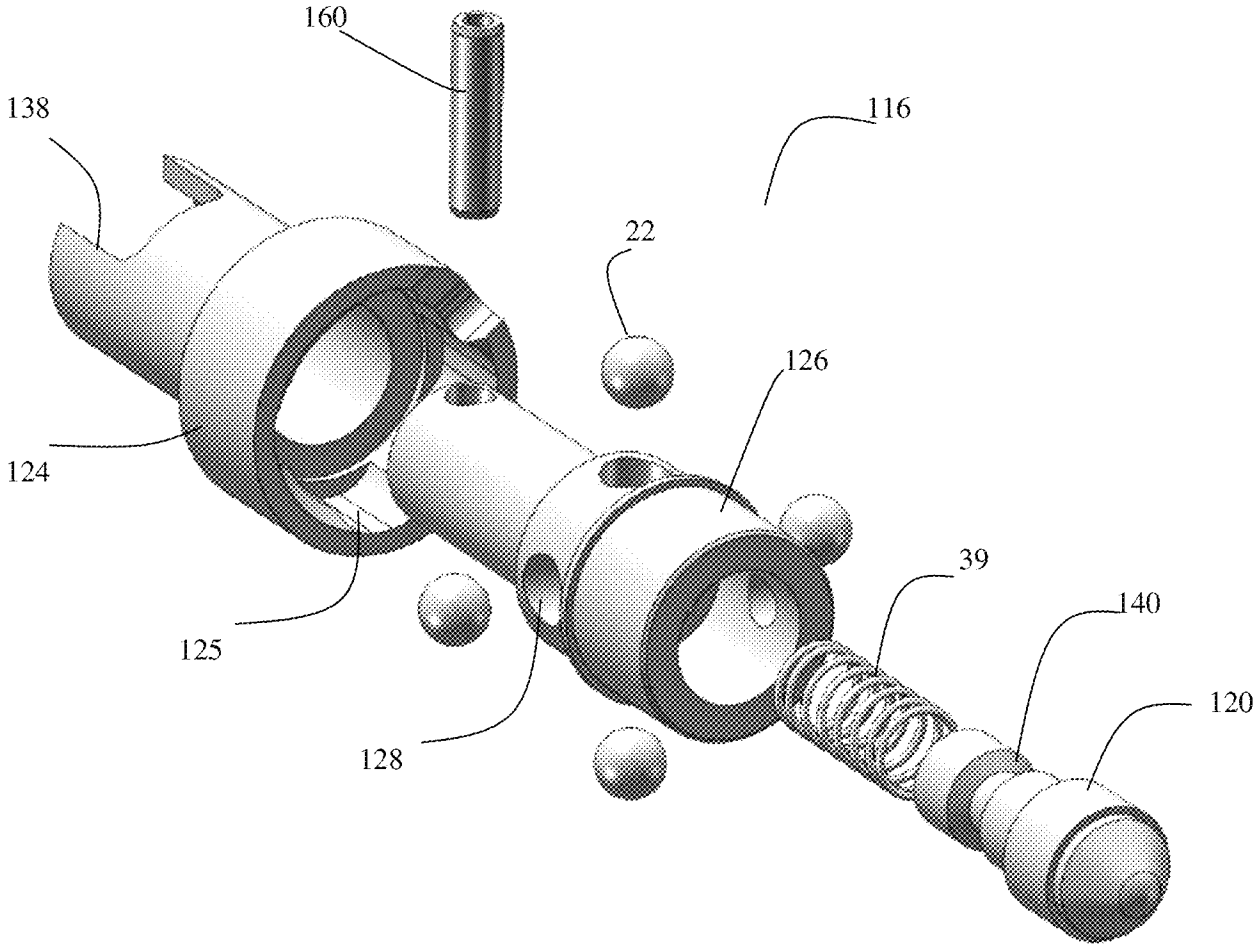
FIG. 7 is an exploded view of another embodiment of a locking mechanism.

Referring to FIG. 7, a locking mechanism is shown including a sleeve 124, a cage 126 and a plunger 120. Cage 126 includes four apertures 128 in which are located locking elements in the form of balls 22. Sleeve 124 includes a series of four recesses 125 provided about its inside surface. When assembled, retaining pin 160 maintains sleeve 124 engaged to cage 126 and also serves to limit to the rotation of sleeve 124 with respect to cage 126 by engaging with arms of dog 138

Figure 8:
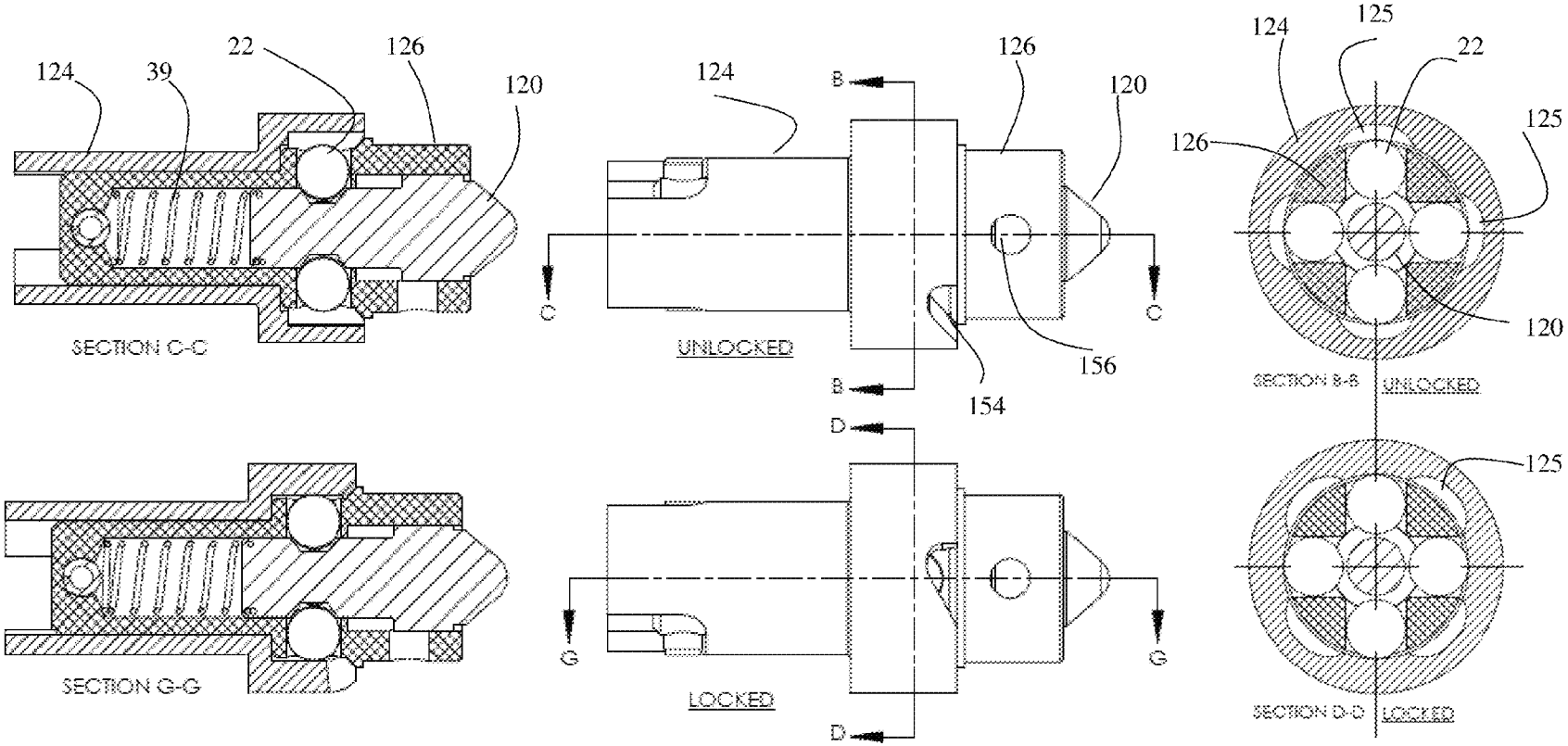
FIG. 8 shows additional views of the locking mechanism of FIG. 7.

Referring to FIG. 8, as best seen at section B-B, when the sleeve 124 is in the unlocked position, recesses 125 align with the positions of balls 22. In this position, plunger 120 may be pushed inwardly as balls 22 are free to move outwardly to enter recesses 125.

To move to the locked position, sleeve 124 is rotated by 45 degrees. As best seen in section D-D, balls 22 are now prevented from moving outwardly but are retained by sleeve 124 in engagement with recess 140 of plunger 120. In this position, plunger 120 cannot be pushed inwards.

Figure 9:
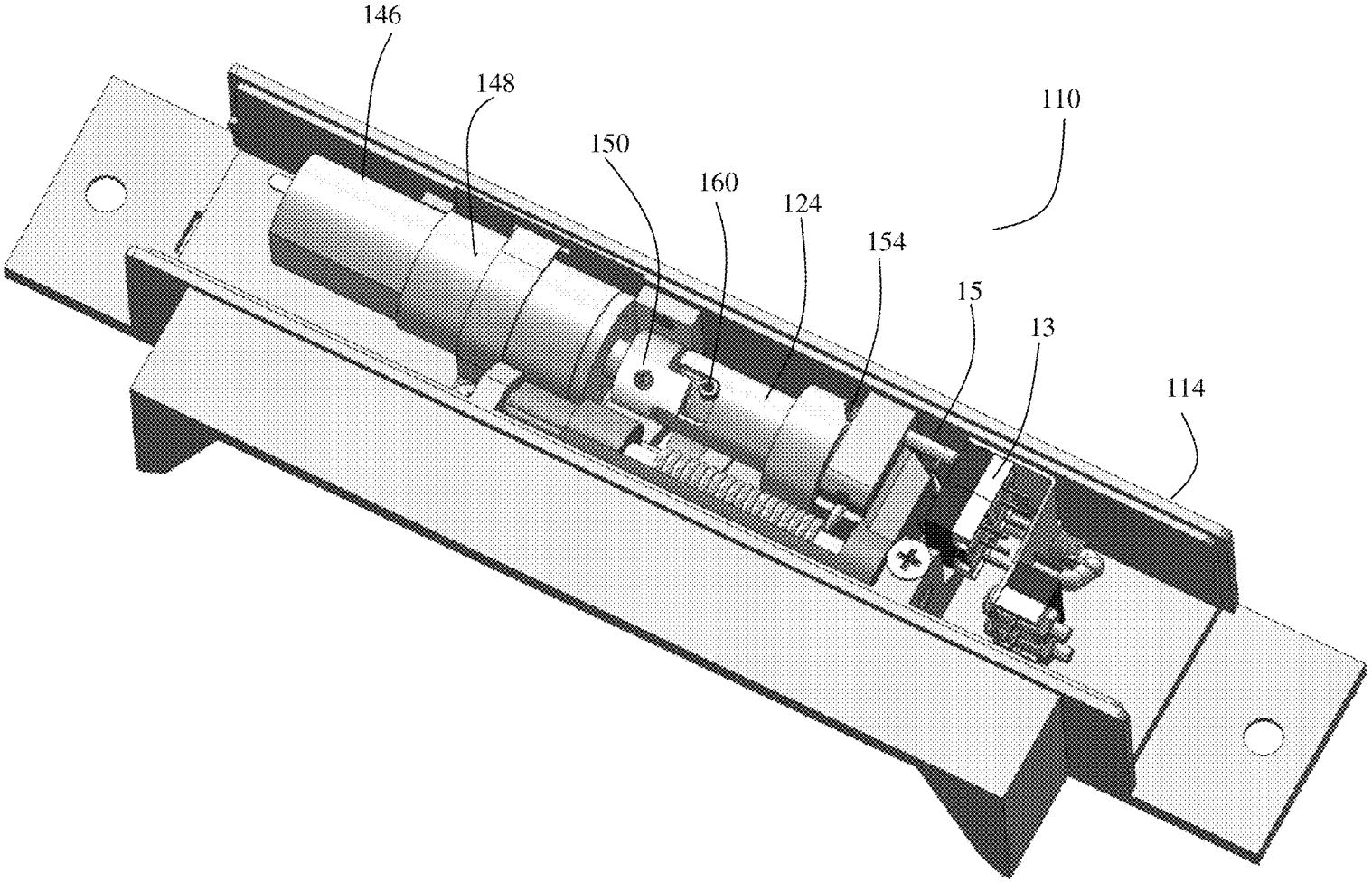
FIGS. 9 and 10 shows the locking mechanism of FIG. 7 incorporated into an electric strike.
Figure 10:
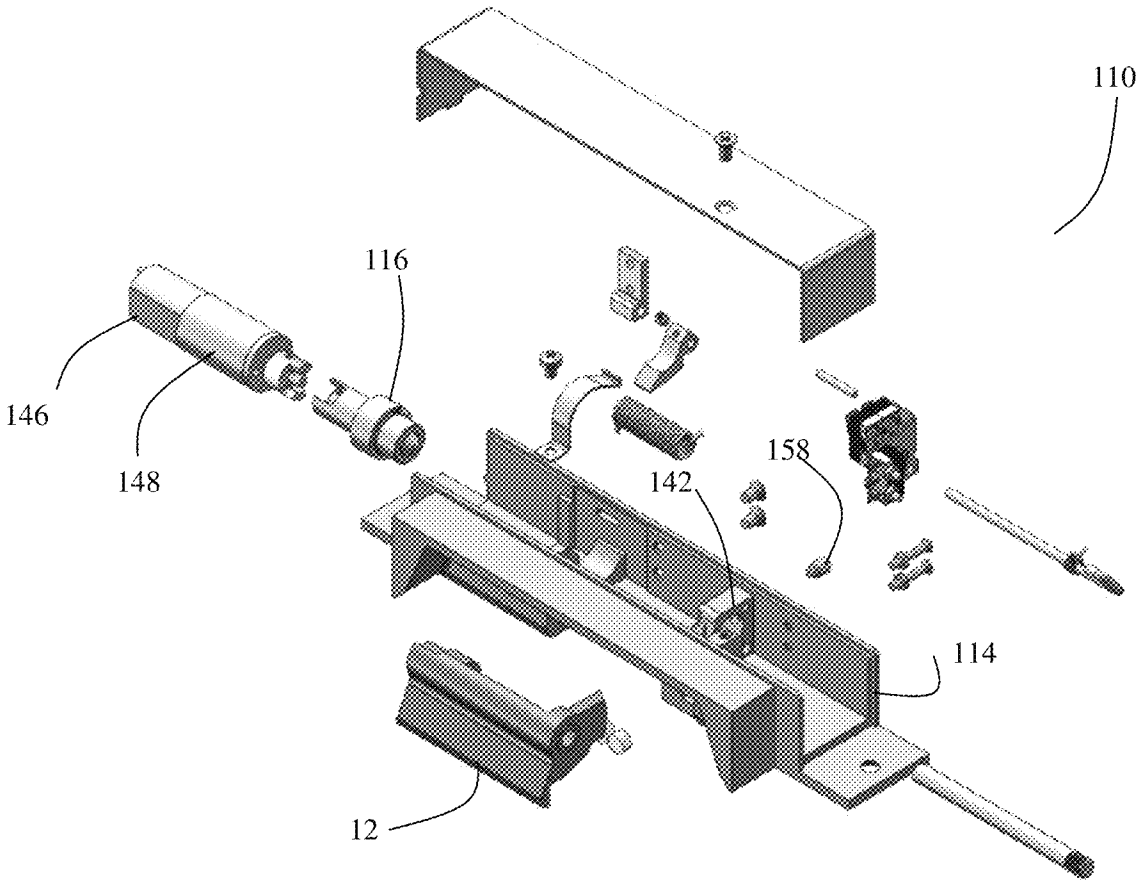

Referring to FIGS. 9 and 10, locking mechanism 116 fits to housing 114 by being inserted into aperture 142 from the left side as seen in the figures and is secured by set screw 158 engaging with aperture 156 (see FIG. 8).

Sleeve 124 is arranged to be rotated by way of a motor 146 and gearbox 148 combination which engages with sleeve 124 by way of dog 150.

A ramp 154 provided on the end of sleeve 124 actuates pushrod 15 to depress microswitch 13 thus enabling remote monitoring of whether the strike 110 is in a locked condition.

Figure 11:
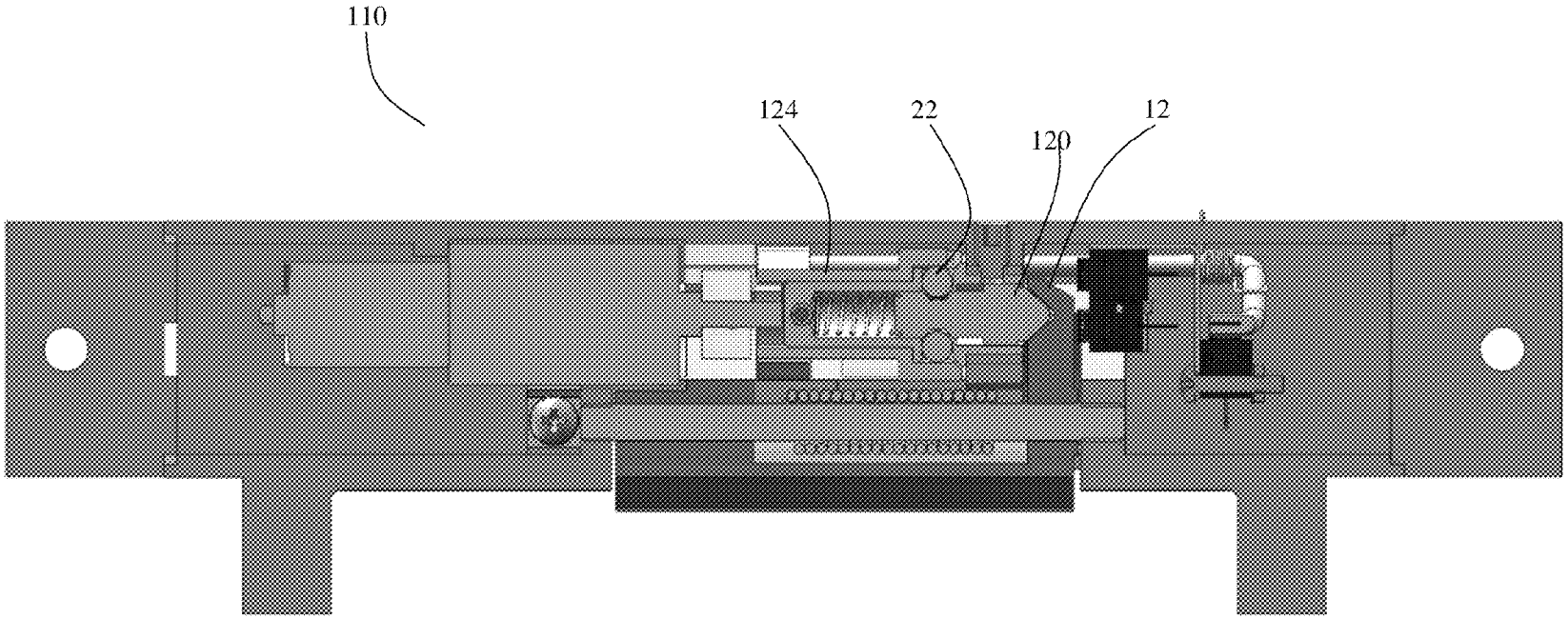
FIGS. 11 to 13 depict a sequence of operation of the electric strike of FIG. 9.
Figure 12:
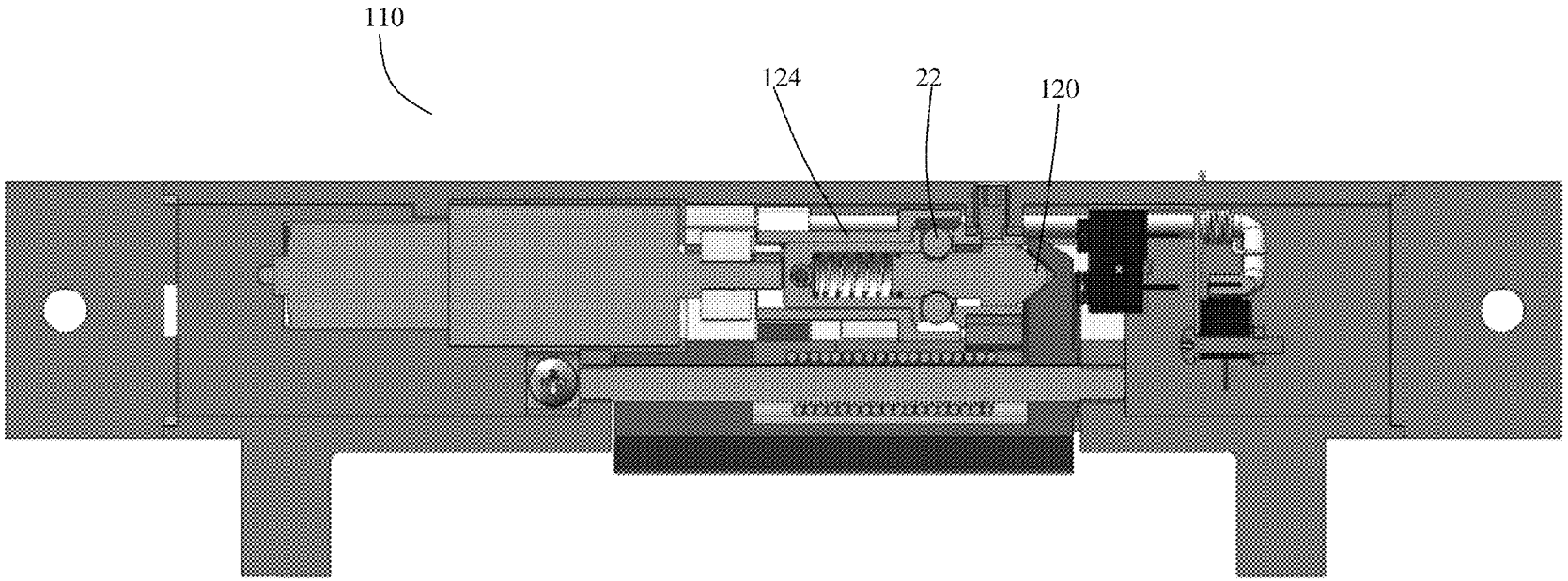
Figure 13:
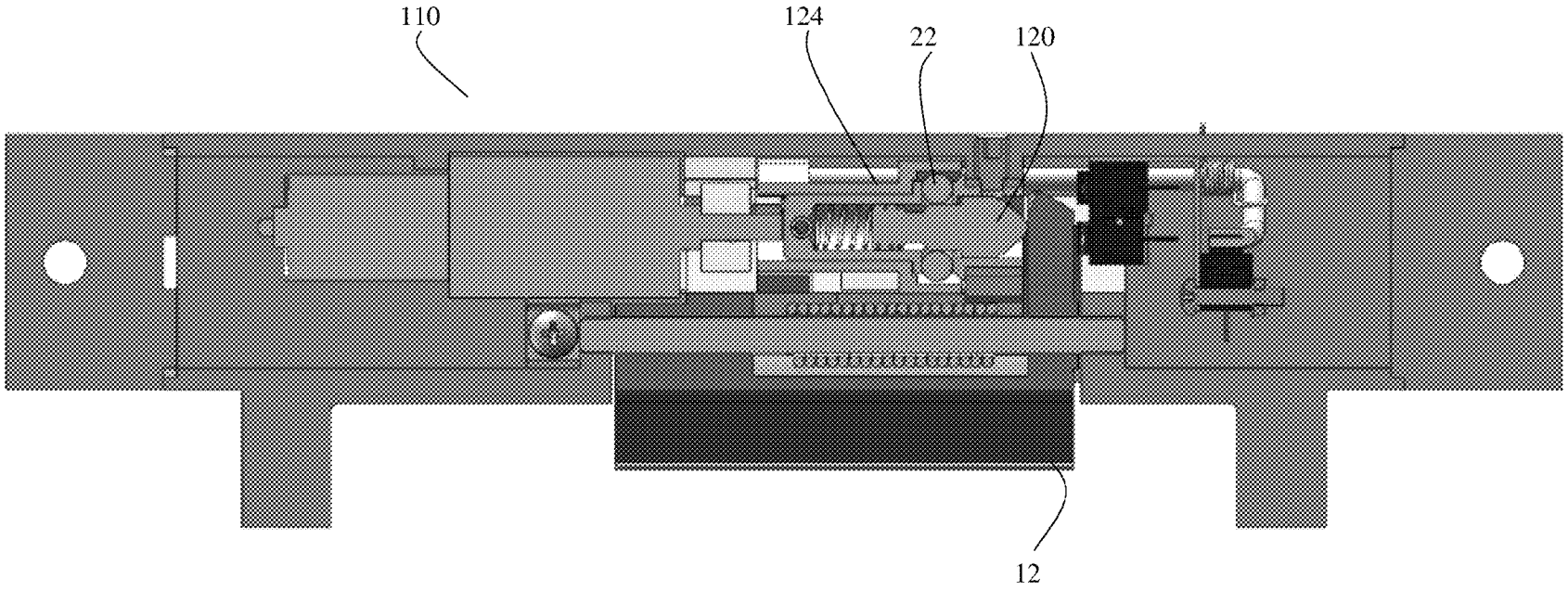

The sequence of operation of the strike 110 moving from the locked to the unlocked and open conditions is shown in FIGS. 11 to 13. In FIG. 11, sleeve 124 is in the locked position. Plunger 120 is prevented from being pushed into cage 126 by way of balls 22 engaging with recess 140 of plunger 120 and therefore keeper 12 is maintained in the closed position.

In FIG. 12, sleeve 124 has been rotated through 45 degrees so that the recesses 125 align with balls 22.

In FIG. 13, keeper 12 has rotated to the open position, pushing plunger 120 inwardly of cage 126.

It has been found that locking mechanisms according to embodiments of the invention have excellent operating characteristics under pre-load conditions. That is, the sleeve of the locking mechanism can be moved with respect to the cage even whilst a considerable force is simultaneously being applied to the plunger of the mechanism.

Whilst the above described embodiment utilised a motor and gearbox to drive the lock mechanism, in other embodiments a motor could be used without a gearbox. As a further alternative, the mechanism can be driven by a solenoid.

Whilst the locking mechanism has been described with reference to use in a locking device in the form of an electric strike, it can similarly be used in locks of other types including gate locks, drop bolts and electric mortise locks.

It can be seen that embodiments of the invention have at least one of the following advantages:

Locking mechanism has excellent pre-load characteristics

In the event of loss of power, lock can be moved to unlocked condition using on board power supply Any reference to prior art contained herein is not to be taken as an admission that the information is common general knowledge, unless otherwise indicated.

Finally, it is to be appreciated that various alterations or additions may be made to the parts previously described without departing from the spirit or ambit of the present invention.

The invention claimed is:

1. An electric strike including: a housing; a keeper pivotally mounted in the housing and being moveable between a closed position and an open position; a plunger cooperating with a formation on the keeper; a plurality of locking elements, the locking elements being generally spherical; a cage including apertures in which the locking elements are housed; and a sleeve; the sleeve is movable with respect to the cage between an unlocked position and a locked position; when in the locked position, the sleeve maintains the locking elements in engagement with a recess on the plunger, preventing movement of the plunger and therefore, preventing movement of the keeper from the closed position to the open position; wherein the sleeve is moved between its unlocked and locked position by a rotation of the sleeve, when in the unlocked position, the sleeve releases the engagement of the locking elements with the recess on the plunger, allowing movement of the plunger, and therefore, allowing the keeper to move from the closed position to the open position, wherein the movement of the keeper from the closed position to the open position causes movement of the plunger through the cooperation of the plunger with the formation on the keeper.

2. An electric strike according to claim 1 wherein the sleeve includes a threaded portion and whereby rotation of the sleeve causes it to move along its thread.

3. An electric strike according to claim 1 wherein the plunger is biased towards an extended position, in which the plunger engages with the formation on the keeper, by way of a spring.

4. An electric strike according to claim 1 wherein the rotation of the sleeve is driven by a motor and gearbox.

5. An electric strike according to claim 1 wherein the electric strike being powered by an external power source, the electric strike further including an onboard power source which is arranged to provide power to selectively move the sleeve to its unlocked position in response to power from the external power source being cut to the lock.

* * * * *